United States Patent [19]

Sherby et al.

[11] 3,955,933

[45] May 11, 1976

[54] MAGNESIUM-BORON PARTICULATE COMPOSITES

[75] Inventors: Oleg D. Sherby, Palo Alto, Calif.; Irvin C. Huseby, Stuttgart, Germany; Robert Whalen, La Plata, Argentina; Steven L. Robinson, Palo Alto, Calif.

[73] Assignee: The United States of America as represented by the Secretary of the Navy, Washington, D.C.

[22] Filed: May 23, 1974

[21] Appl. No.: 472,577

Related U.S. Application Data

[63] Continuation-in-part of Ser. No. 230,396, Feb. 29, 1972, abandoned, and a continuation-in-part of Ser. No. 355,268, Feb. 26, 1973, Pat. No. 3,827,921.

[52] U.S. Cl. ..... 29/182.5; 29/182; 75/168 R; 148/11.5 M

[51] Int. Cl.[2] ..... B22F 3/00; B22F 5/00; C22C 23/00

[58] Field of Search ..... 29/182, 182.5, 191; 75/168 R, 202; 148/11.5

[56] References Cited

UNITED STATES PATENTS

| | | | |
|---|---|---|---|
| 3,189,441 | 6/1965 | Frost et al. | 75/168 R |
| 3,189,442 | 6/1965 | Frost et al. | 75/168 R |
| 3,333,956 | 8/1967 | Foerster | 75/168 R |
| 3,827,921 | 8/1974 | Sherby et al. | 75/168 |

OTHER PUBLICATIONS

Constitution q Binary Alloys, First Supplement, Rodney Elliott, 1965, pp. 124, 125.

Constitution q Binary Alloys, Second Supplement, Francis Shunk, 1969, p. 90.

*Primary Examiner*—Leland A. Sebastian
*Assistant Examiner*—Josephine Lloyd
*Attorney, Agent, or Firm*—R. S. Sciascia; Charles D. B. Curry

[57] ABSTRACT

A magnesium-boron composite is made by mechanically mixing magnesium powders with boron powders. An alternative embodiment includes mixing a small amount of lithium powder with the magnesium boron composite to improve the ductility. The mixed powders are processed by cold pressing, hot pressing, sintering, extruding, rolling and re-extruding.

7 Claims, 1 Drawing Figure

STAGES
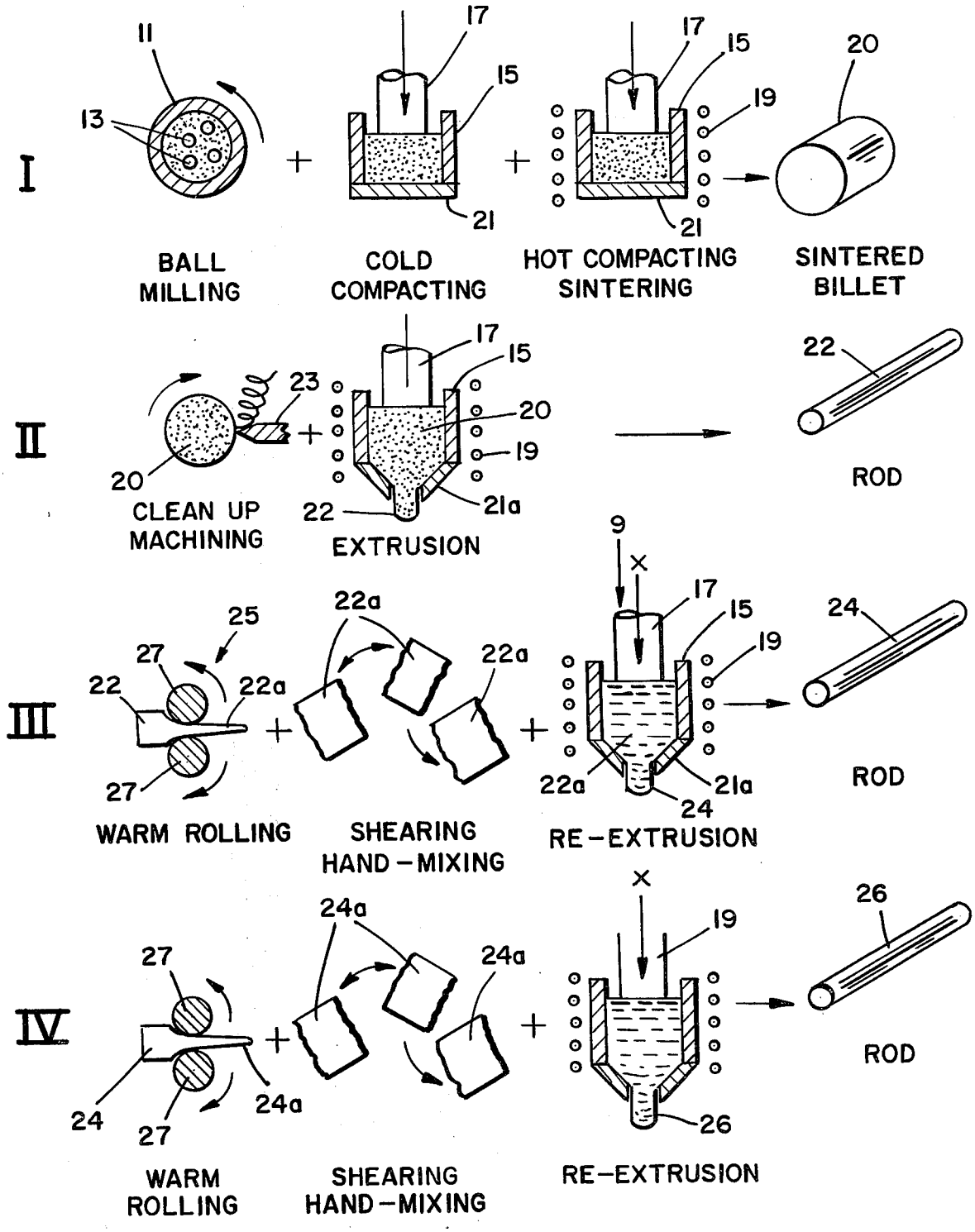

MAGNESIUM-BORON PARTICULATE COMPOSITES

This application is a continuation-in-part of U.S. patent application Ser. No. 230,396 filed Feb. 29, 1972 now abandoned; and patent application Ser. No. 355,268 filed Feb. 26, 1973 now U.S. Pat. No. 3,827,921 by Oleg D. SHERBY, Irvin C. HUSEBY and Robert WHALEN.

BACKGROUND OF THE INVENTION

1. Field of the Invention

The present invention relates generally to a magnesium-boron composite, and more particularly, to making magnesium-boron composites by mechanically mixing magnesium powders with boron powders. A small amount of lithium may be added for ductility.

2. Description of the Prior Art

The ratio of elastic modulus E over the density p, known as specific stiffness E/p, hereinafter referred to as E/p, is a very important design criterion for many structural components such as I-beams, and the like. Materials with high E/p values are especially useful in aero-space applications where stiff materials with low densities are needed.

Most structural materials, for example, steel, aluminum, nickel, titanium, magnesium and their alloys, have roughly the same E/p values of about $100 \times 10^6$ in. It should be noted that among these materials the density tends to increase as the elastic modulus E increases, yielding approximately constant E/p values. For example, although the elastic modulus E of steel is 4.8 times that of Magnesium (Mg), the density of steel is about 4.5 times that of Magnesium (Mg). There are relatively few ways of increasing the elastic stiffness for a material. Since modulus varies with orientation in a single crystal, one method is to produce a specific orientation for most of the grains in a polycrystalline material. This will yield an anisotropic material, that is, E will be high in some direction but low in other directions. Such a material may be undesirable in some design applications.

SUMMARY OF THE INVENTION

Briefly, the present invention is a magnesium-boron composite and is made by mechanically mixing magnesium powder with boron powders. A small amount of lithium may be added to the composite to make the composite more ductile. The mixed powders are then cold pressed, hot pressed, sintered, extruded, rolled, and finally re-extruded. The new product of the unique method will overcome the aforementioned problems. The unique method of making the completely new alloy includes layering of the mixture before extruding which results in a composite alloy with a specific stiffness of about one and one-half times of any other known alloy.

STATEMENT OF THE OBJECTS OF THE INVENTION

The primary object of the present invention is to make a completely new alloy.

Another object of the present invention is to illustrate a unique method of producing a new alloy.

Another object of the present invention is to make a new alloy with a specific stiffness of about one and one-half times that of any other known magnesium alloy.

Other objects and features will be apparent from the accompanying drawings in which the sole FIGURE is a flow diagram of the method for making the magnesium-boron composites.

DESCRIPTION OF THE PREFERRED EMBODIMENTS

The magnesium-boron composites are made by mechanically mixing magnesium powder with from about five percent by volume to about thirty percent by volume boron powders. The mixed powders are then cold pressed, hot pressed, sintered, extruded, rolled and re-extruded. This unique process will be described in conjunction with Example I of the magnesium-boron composite. Fourteen percent by weight of lithium may be added to the magnesium powder for added ductility. Magnesium powder, such as RMC-100 or 100 mesh, or the like, produced by Read Manufacturing Company, can be used. Magnesium-lithium alloys in a solid rod form with 14.1% lithium, ground down to a 100 mesh size powder, may be used. This particular magnesium-lithium alloy contains about fourteen percent lithium by weight. The modulus of elasticity of this alloy is about $6.5 \times 10^6$ psi with a density of 1.35 gm/cm$^3$. A description of processing the magnesium lithium alloy will be forthcoming in conjunction with Example V. It should be noted that lithium powder may be obtained in essentially pure form and then mixed with the magnesium and boron in the proper percentage.

Specific examples of the magnesium-boron and the magnesium plus lithium and boron composites, which were made in accordance with the present invention, are described below:

EXAMPLE IA

| | |
|---|---|
| Magnesium (Mg) | 75% |
| Boron | 25% |

The percentages of boron (B) and magnesium (Mg) are by volume.

The method described below is not limited to Example IA only but may be used in producing any generic groups of particulate composites. The method employed for mechanically mixing the magnesium (Mg) powder and the boron (B) powder is described in detail in co-pending case Ser. No. 355,268 U.S. Pat. No. 3,827,921.

BRIEF DESCRIPTION OF THE DRAWING

The DRAWING is a flow diagram of Stage I, II, III, and IV of the disclosed process.

Referring to the flow diagram in the first stage, the magnesium (Mg) and boron (B) powders were mixed by ball milling in a standard cylindrical ball mill container 11. Small alundum grinding spheres 13 are added to facilitate proper mixing. Next, the mixed magnesium (Mg) and boron (B) powders are compacted, sintered and extruded. The compacting, sintering and extruding are all done in a steel cylinder 15. The dimensions of cylinder 15 are of about 1.25 inches in diameter and about six inches in length. Cylinder 15 includes a bottom blank plug 21 which can be removed and replaced with extrusion die 21*a*. Pressure is applied to piston 17 with a 60,000 pound capacity Reihle Universal testing machine or a similar apparatus. The loose mixed magnesium (Mg) and boron (B) powders are placed into cylinder 15 and cold compacted to about 35 KSI and then hot compacted by activating heating device 19. The cold compacted mixture of magnesium (Mg) and boron (B) is heated to about 390°C and sintered for about thirty minutes. Finally, a 40 KSI pressure is applied for about five minutes to complete stage I. The resultant product is sintered billet 20. The sintered billet 20 is then removed from cylinder 15 and cooled.

In stage II billet 20 is cooled further, then machined by lathe 23 until the entire surface of sintered billet 20 has a uniform nonporous appearance. The sintered clean billet 20 is then placed back into cylinder 15 of extrusion assembly 9. The bottom blank plug 21 is replaced by extrusion die 21*a*. Die 21*a* has a minimum aperture diameter of about 0.277 inches. The billet 20 is then extruded at a temperature of about 390°C and at a rate of about two inches per minute, with no lubrication, for form rod 22. This completes stage II.

In stage III rod 22, from the first extrusion of stage II, is heated to about 300°C by an external heating means and then rolled into strips 22*a* of about 0.01 inches thick with rolling device 25. Rollers 27 of rolling device 25 are not heated. The rolled strips 22*a* are edge-cracked and fragmented. As the final thickness of 0.01 inches is approached, several pieces of about one inch wide and about three inches long typify the product to be mixed and re-extruded. The rolled fragments 22*a* are mixed by hand and placed back into extrusion assembly 9. The mixed fragments 22*a* are cold packed to about 35 KSI and then re-extruded at a temperature of about 390°C to form rod 24. This completes phase III. It should be noted that the mixed fragments 22*a* naturally orient, under pressure, with their flat surfaces perpendicular to the extrusion axis X. Thus, the extrusion direction for this second extrusion is perpendicular to the original extrusion axis in each small fragment 22a so that with the second extrusion a very turbulent mixing occurs to give better homogeneity of the alloy which has been shown by standard testing methods.

In stage IV rod 24, as in stage III, is heated to a temperature of about 300°C and again warm rolled, as in stage III, into 0.01 inch sheer strips 24*a*. Strips 24*a* are again mixed by hand and placed into extrusion apparatus 9 and extruded for a third time at about 40 KSI into the final 0.277 inch rod 26. In this case, rod 26 (Example IA) was tested in an Instron Machine, Marshall Furnace and a special compression apparatus at temperatures varying from about 24° to about 325°C. A compression sample of 0.300 in. in length by 0.200 in. in diameter was ground from rod 26. An elastic modulus E value of about $11.3 \times 10^6$ psi was obtained for the composite alloy of Example IA. It was also found that the composite alloy had a specific stiffness ratio E/p of about $166 \times 10^6$ in. This is about 1.7 times that of pure magnesium. A chart follows illustrating the relationship between the unique magnesium based composite of Example IA with that of pure magnesium:

| Material | E | E/p |
|---|---|---|
| BoroMag | $11.3 \times 10^6$ psi | $166 \times 10^6$ in. |
| Magnesium | $6.2 \times 10^6$ psi | $100 \times 10^6$ in. |

Example I was found to have some ductility; that is about 3% tensile strain when tested on the Instron Machine at a temperature of about 25°C and at a rate of deformation of about 0.02 in/min. It should be noted that the examples recited below were also tested under similar conditions to those used in testing Example IA for purposes of uniformity. The method described above may be used to make the examples recited below.

EXAMPLE I

| | |
|---|---|
| Magnesium (Mg) | 80% |
| Boron (B) | 20% |

The percentages of magnesium (Mg) and boron (B) are percentages by volume.

The method used for mechanically mixing the above example is essentially the same as described with respect to Example IA. The above example was tested in an Instron Machine, Marshall Furnace and a special compression apparatus, at a temperature varying from about 24°C to about 325°C. A compression sample of 0.300 in. in length by 0.200 in. in diameter was ground from rod 26. An elastic modulus E value of about $9.9 \times 10^6$ psi was obtained for this example. It was found that the composite alloy had a specific stiffness ratio E/p of about $135 \times 10^6$ in. This is about 1.2 times that of pure magnesium. The above example was found to have about 4% tensile strain when tested on the Instron Machine.

EXAMPLE II

| | |
|---|---|
| Magnesium (Mg) | 75% |
| Boron (B) | 25% |

The percentages of boron (B) and magnesium (Mg) are by volume. Example II is the same as Example IA. Therefore the data disclosed in Example IA is the same for Example II. Example II is repeated to show the range of reliability of the magnesium-boron composite.

EXAMPLE III

| | |
|---|---|
| Magnesium (Mg) | 70% |
| Boron (B) | 30% |

The percentages of magnesium (Mg) and boron (B) are by volume. The method used for mechanically mixing this example is essentially the same as described with respect to Example IA.

The above example was tested in an Instron Machine, Marshall Furnace and a special compression apparatus at a temperature varying from about 24° to about 325°C. A compression sample of 0.300 in. in length by 0.200 in. in diameter was ground from rod 26.

An elastic modulus E value of about $13 \times 10^6$ psi was obtained for the above example. Moreover, it is found that the composite alloy had a specific stiffness ratio E/p of about $219 \times 10^6$ in. This is about 2 times that of pure magnesium. The above example was found to have a tensile strain of about 1.0% when tested on the Instron Machine.

Example III is given to illustrate the degradation of the ductility of magnesium boron composites if greater than 30% boron was used. It has been found by experimentation that when the boron was added to the magnesium so that it represented more than 30% by volume the tensile strain dropped off in a non linear fashion. Therefore the optimum range for the boron (B) and magnesium composite is from about 20% boron (B) to about 30% boron (B). It has also been found that the alternative embodiment which adds lithium (Li) of 14% by weight to the magnesium (Mg) yields a solid solution of a very high ductility magnesium boron alloy.

The forth coming Examples IV-VIII illustrate the magnesium (Mg) plus lithium (Li) and boron (B) composites which were made in accordance with the present invention and which are described below.

EXAMPLE IV

| | | |
|---|---|---|
| | Magnesium (Mg) | 95% |
| + | Lithium (Li) (14% by weight MgLi) | |
| | Boron (B) | 5% |

The percentages of magnesium (Mg) + lithium (Li) alloy and boron (B) are percentages by volume. The percentage of lithium (Li) is the percentage by weight of the magnesium (Mg) + lithium (Li) powder.

The method for mechanically mixing the magnesium (Mg) + lithium (Li) alloy and boron (B) is essentially the same as described with respect to Example IA except that the magnesium (Mg) + lithium (Li) alloy, which contains lithium at 14% by weight, must be first ground to a powder that is a 100 mesh size, to mix with the boron (B).

The above example was tested in an Instron Machine, Marshall Furnace and a special compression apparatus at a temperature varying from about 24° to about 325°C. A compression sample of 0.300 in. in length by 0.200 in. in diameter was ground from rod 26. The above example was found to have an elastic modulus E value of about $7.5 \times 10^6$ psi and a specific stiffness ratio E/p of about $145 \times 10^6$ in. Moreover, it was found that the ductility of the above example was improved. The above example was tested and found to have a tensile strain of about 23% as compared with Examples I–III which have a tensile strain range from about 4% to about 1%.

EXAMPLE V

| | | |
|---|---|---|
| | Magnesium (Mg) | 90% |
| + | Lithium (Li) (14% by weight MgLi) | |
| | Boron (B) | 10% |

The percentages of the magnesium (Mg) + lithium (Li) alloy and boron are percentages by volume. The percentage of lithium (Li) is the percentage by weight of the magnesium (Mg) + lithium (Li) powder.

The method for mechanically mixing the magnesium (Mg) + lithium (Li) alloy and boron (B) is essentially the same as described with respect to Examples I and IV.

The above example was tested in the same manner and over the same ranges as described with respect to Examples I–III. A compression sample of 0.300 in. in length by 0.200 in. in diameter was ground from rod 26. The above example was found to have an elastic modulus E value of about $8.8 \times 10^6$ psi and a specific stiffness ratio E/p of about $167 \times 10^6$ in. Moreover, it was found that the ductility of the above example was highly improved. The above example was tested in an Instron Machine and found to have a tensile strain of about 19% as compared with Example IA which has a tensile strain of about 3.0%.

EXAMPLE VI

| | | |
|---|---|---|
| | Magnesium (Mg) | 85% |
| + | Lithium (Li) (14% by weight MgLi) | |
| | Boron (B) | 15% |

The percentages of the magnesium (Mg) + lithium (Li) alloy and the boron (B) are percentages by volume. The percentage of lithium (Li) is the percentage by weight of the magnesium (Mg) + lithium (Li) powder.

The method for mechanically mixing the magnesium (Mg) + lithium (Li) powder and the boron (B) is essentially the same as described with respect to Examples I–V. A compression sample of 0.300 in. in length by 0.200 in. in diameter was ground from rod 26.

The above example was tested in the same manner and over the same ranges as described with respect to Examples I–V. The above example was found to have an elastic modulus E value of about $10.0 \times 10^6$ psi and a specific stiffness ratio E/p of about $175 \times 10^6$ in. The above example was tested in the same manner and configuration as Example V and found to have a tensile strain of about 14% or less as compared with Examples I–III which have a tensile strain from about 4% to about 1%.

EXAMPLE VII

| | | |
|---|---|---|
| | Magnesium (Mg) | 80% |
| + | Lithium (Li) (14% by weight MgLi) | |
| | Boron (B) | 20% |

The percentages of the magnesium (Mg) + lithium (Li) alloy and the boron (B) are percentages by volume. The percentage of lithium (Li) is the percentage by weight of the magnesium (Mg) + lithium (Li) powder.

The method for mechanically mixing the magnesium (Mg) + lithium (Li) powder and the boron (B) is essentially the same as described with respect to Examples I–VI. A compression sample of 0.300 in. in length by 0.200 in. in diameter was ground from rod 26.

The above example was tested in the same manner and over the same ranges as described with respect to Example VI.

The above example was found to have an elastic modulus E value of about $11.3 \times 10^6$ psi and a specific stiffness ratio E/p of about $190 \times 10^6$ in. The above example was tested in the same manner and configuration as Example II and found to have a tensile strain of about 8.0% as compared with Examples I–III which have a tensile strain from about 4% to about 1%.

EXAMPLE VII

| | | |
|---|---|---|
| | Magnesium (Mg) | 75% |
| + | Lithium (Li) (14% by weight MgLi) | |
| | Boron (B) | 25% |

The percentages of the magnesium (Mg) + lithium (Li) alloy and boron are percentages by volume. The percentages of lithium (Li) is the percentage by weight of the magnesium (Mg) + lithium (Li) powder.

The method for mechanically mixing the magnesium (Mg) + lithium (Li) alloy and boron (B) is essentially the same as described with respect to Examples I–VI.

The above example was tested in the same manner and over the same ranges as described with respect to Examples I–VI. A compression sample of 0.300 in. in length by 0.200 in. in diameter was ground from rod 26. The above example was found to have an elastic modulus E value of about $13.7 \times 10^6$ psi and a specific stiffness ratio E/p of about $210 \times 10^6$ in. Moreover, it was found that the ductility of the above example was highly improved. The above example was tested in an Instron Machine and found to have a tensile strain of about 5.0% as compared with Examples I and II which have a tensile strain of about 3.0%.

Example VIII is given to illustrate the degradation of the ductility of magnesium boron composites when greater than 30% boron is used. It was also found that when the 14% by weight of lithium (Li) is added to the magnesium (Mg) with greater than 30% boron, the tensile strain is only a little over 1.5%.

EXAMPLE IX

| | |
|---|---|
| Magnesium (Mg) | 70% |
| Boron (B) | 30% |

The percentage of magnesium (Mg) and boron (B) are percentages by volume.

The method used for mechanically mixing this example was essentially the same as described with respect to Example IA as well as I–VIII.

The above example was tested in an Instron Machine, Marshall Furnace, and a special compression apparatus at a temperature varying from about 24°C to about 325°C. A compression sample of 0.300 in. in length by 0.200 in. in diameter was ground from rod 26. The elastic modulus E value was about $15.6 \times 10^6$ psi and the specific stiffness ratio E/p was found to be about $230 \times 10^6$ in.

The above example was found to have a tensile strain of about 1 ½ to about 4%. This would tend to show that above the 30% range of boron (B) the ductility degrades to such a level that the composite is to brittle to have any useful purpose. Therefore, it appears that the optimum range is from about 5% by volume to about 30% by volume of boron, as shown in the examples above.

What is claimed is:

1. A sintered magnesium-boron powdered composite alloy comprising:

a. magnesium;

b. boron;

c. lithium, said lithium being about 14 percent by weight of said magnesium; and d. said boron comprising from about 5 percent by volume to about 30 percent by volume.

2. The alloy recited in claim 1 wherein said boron is about 5 percent by volume of said magnesium and lithium taken together.

3. The alloy recited in claim 1 wherein said boron is about 10 percent by volume of said magnesium and lithium taken together.

4. The alloy recited in claim 1 wherein said boron is about 15 percent by volume of said magnesium and lithium taken together.

5. The alloy recited in claim 1 wherein said boron is about 20 percent by volume of said magnesium and lithium taken together.

6. The alloy recited in claim 1 wherein said boron is about 25 percent by volume of said magnesium and lithium taken together.

7. The allow recited in claim 1 wherein said boron is about 30 percent by volume of said magnesium and lithium taken together.

* * * * *